US005736219A

United States Patent [19]

Suehr et al.

[11] Patent Number: 5,736,219

[45] Date of Patent: Apr. 7, 1998

[54] ABSORBENT NONWOVEN FABRIC

[75] Inventors: Susan Lynn Suehr, Belle Mead; Linda J. McMeekin, Bound Brook; James E. Knox, Jamesburg; Frank J. Flesch, Toms River, all of N.J.

[73] Assignee: McNeil-PPC, Inc., Skillman, N.J.

[21] Appl. No.: 661,858

[22] Filed: Jun. 11, 1996

Related U.S. Application Data

[63] Continuation of Ser. No. 398,715, Mar. 6, 1995, abandoned, which is a continuation of Ser. No. 112,922, Aug. 30, 1993, abandoned.

[51] Int. Cl.[6] ..... B32B 5/12; D04H 3/10

[52] U.S. Cl. ..... 428/113; 428/114; 428/167; 428/171; 442/366

[58] Field of Search ..... 428/113, 114, 428/167, 171; 442/366

[56] References Cited

U.S. PATENT DOCUMENTS

| | | | |
|---|---|---|---|
| 3,486,168 | 12/1969 | Evans et al. | 428/163 |
| 3,906,130 | 9/1975 | Tsurumi et al. | 428/131 |
| 4,016,319 | 4/1977 | Marshall | 428/113 |
| 4,183,995 | 1/1980 | Marshall | 428/284 |
| 4,925,722 | 5/1990 | Jeffers et al. | 428/131 |
| 5,098,764 | 3/1992 | Drelich et al. | 428/131 |
| 5,149,332 | 9/1992 | Walton et al. | 604/358 |

*Primary Examiner*—Kathleen Choi

[57] ABSTRACT

A non-woven fabric having improved absorbent characteristics. The fabric has three different fiber arrays which are interconnected to produce a unique fiber distribution in the fabric.

7 Claims, 10 Drawing Sheets

ABSORBENT NONWOVEN FABRIC

This is a continuation of application Ser. No. 08/398,715, filed Mar. 6, 1995, now abandoned, which is a continuation of application Ser. No. 08/112,922, filed Aug. 30, 1993, now abandoned.

BACKGROUND OF THE INVENTION

Nonwoven fabrics were developed in an attempt to produce an inexpensive fabric by eliminating many of the various steps required to produce woven or knitted fabrics. Initially, nonwoven fabrics were produced from card or air-laid webs of fibers which were bonded with a chemical binder. Such fabrics have relatively limited usage because their strength characteristics were poor compared to woven or knitted fabrics and their absorbency and softness characteristics left something to be desired because of the use of chemical binders. Major advances were made in eliminating or considerably reducing the amount of binder used in a nonwoven fabric by rearranging or entangling the fibers in a fibrous web to produce what are termed "yarn like" fiber segments and entangled fiber areas. Methods and apparatus for producing fabrics of this nature are more fully disclosed in U.S. Pat. Nos. 2,862,251, 3,033,721, and 3,486,168. While these techniques improve the strength characteristics of nonwoven fabrics, they still did not have the strength characteristics of the woven or knitted fabrics. These entangled or rearranged fiber fabrics did require less binder and, hence, had good absorbent characteristics and excellent softness. As a result of this, nonwoven fabrics found primary uses in many products such as sanitary napkins, disposable diapers, replacement gauze, medical bandages, and the like. While such products were accepted for uses where absorbency and softness was desired, the various different fiber areas would absorb differently. For example, yarn-like structures would absorb different than non-yarn-like structures. Furthermore, many of these fabrics included apertures or holes and while suitable for facing materials, were not suitable for some absorbent products unless used in multilayer configurations. While nonwoven fabrics have gained wide acceptance, it is still desired to improve the absorbent characteristics of such fabrics and make them more efficient in use.

It is an object of the present invention to produce a nonwoven fabric having improved absorbent characteristics. It is a further object of the present invention to produce a nonwoven fabric having relatively uniform absorbent characteristics. It is still a further object of the present invention to produce a nonwoven fabric that has improved absorbent characteristics without any deleterious effects on the other desired properties of nonwoven fabrics.

SUMMARY OF THE PRESENT INVENTION

Nonwoven fabrics of the present invention have substantially uniform absorbent characteristics in all directions within the plane of the fabric. The nonwoven fabric has a repeating pattern of three interconnected fiber arrays. The first fiber array of the fabric comprises a plurality of parallel fiber segments. The second fiber array comprises a plurality of twisted and turned fiber segments that form a band disposed substantially perpendicular to the parallel fiber segments of the first fiber array. The second fiber array is disposed adjacent the first fiber array. The nonwoven fabric of the present invention includes a third fiber array which interconnects the first and second fiber arrays. The third fiber array comprises a plurality of highly entangled fiber segments.

Nonwoven fabrics of the present invention have uniform absorbent characteristics such that the pattern of absorption of fluid by the fabric has a mean roundness factor of 0.6 or greater. Also, the pattern of absorption has a generally smooth perimeter such that it has a mean form factor of 0.7 or greater.

It is believed these combined absorbent properties of the fabrics of the present invention may result from the unique distribution and configuration of fiber in the fabric. Nonwoven fabrics of the present invention have a generally sinusoidal fiber distribution curve over their cross-sectional area. This generally sinusoidal fiber distribution curve of the fabrics of the present invention must meet certain criteria. We have found that one way of defining and measuring these criteria is by mathematically defining the fiber distribution curve. The curve may be defined by the average percentage of area covered by fibers, the cycles or periodicity of the curve and the average amplitude of the curve. We have found that the fabrics of the present invention have a fiber distribution index of at least 600 and preferably at least 800. This fiber distribution index is determined by multiplying the average percentage of area of fiber coverage in a specific measured cross-sectional area of the fabric by one-half the number of clearly identifiable points of minimum fiber coverage over said specific cross-sectional area and dividing this figure by the average amplitude of the fiber distribution curve.

DETAILED DESCRIPTION OF THE INVENTION

Figure 1:
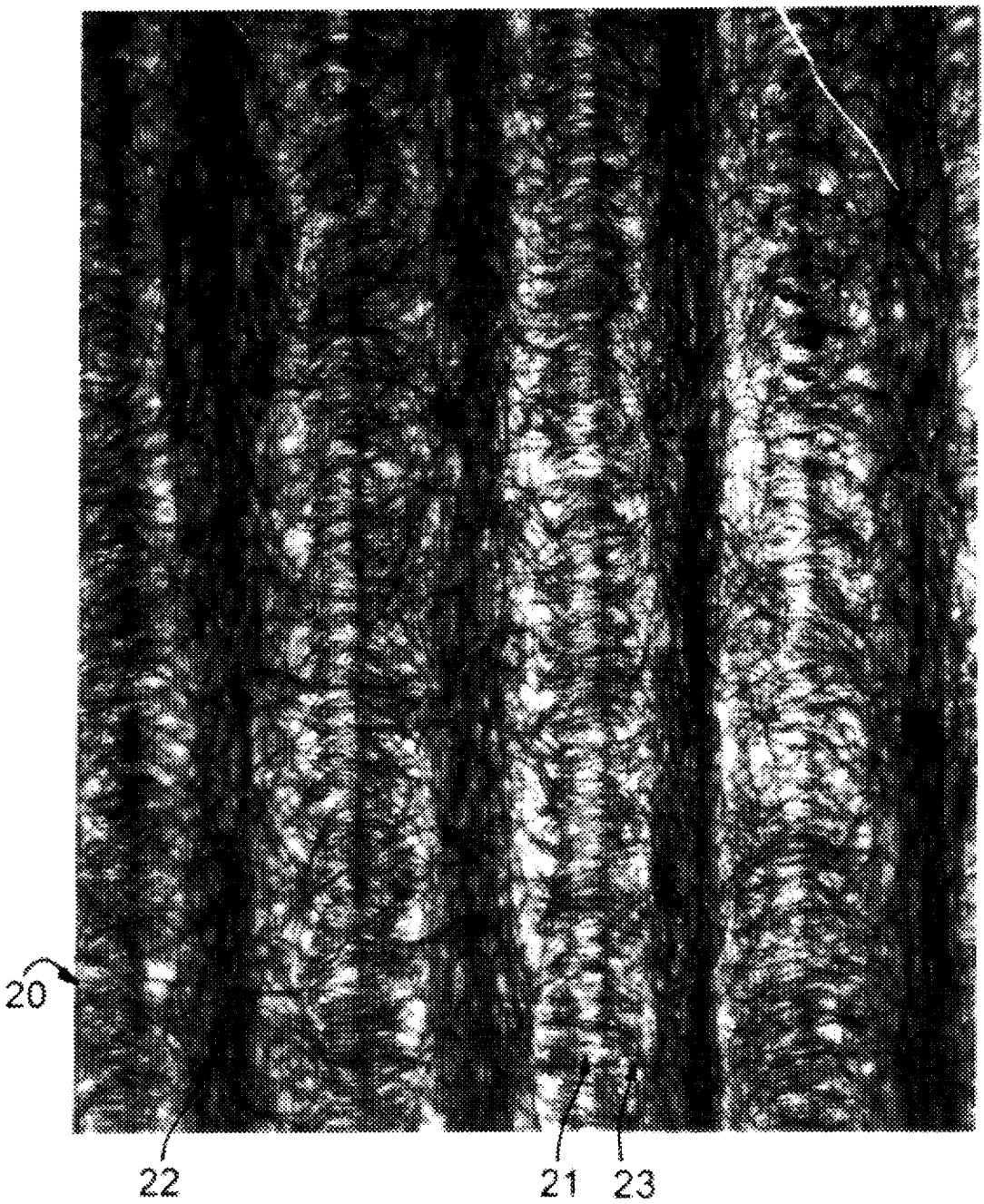
FIG. 1 is a photomicrograph of a nonwoven fabric of the present invention enlarged about 20 times.

Referring to the drawings, FIG. 1 is a photomicrograph of a nonwoven fabric 20 of the present invention at an enlargement of about 20 times. The fabric has a repeating pattern of three interconnected fiber arrays. The first fiber array 21 is a plurality of parallel fiber segments. The second fiber array 22, which is adjacent to the first array, is a plurality of twisted and turned fiber segments that form a band. The band is disposed substantially perpendicular to the parallel fiber segments. The third fiber array 23 interconnects the first and second arrays and comprises a plurality of highly entangled fiber segments.

Figure 2:
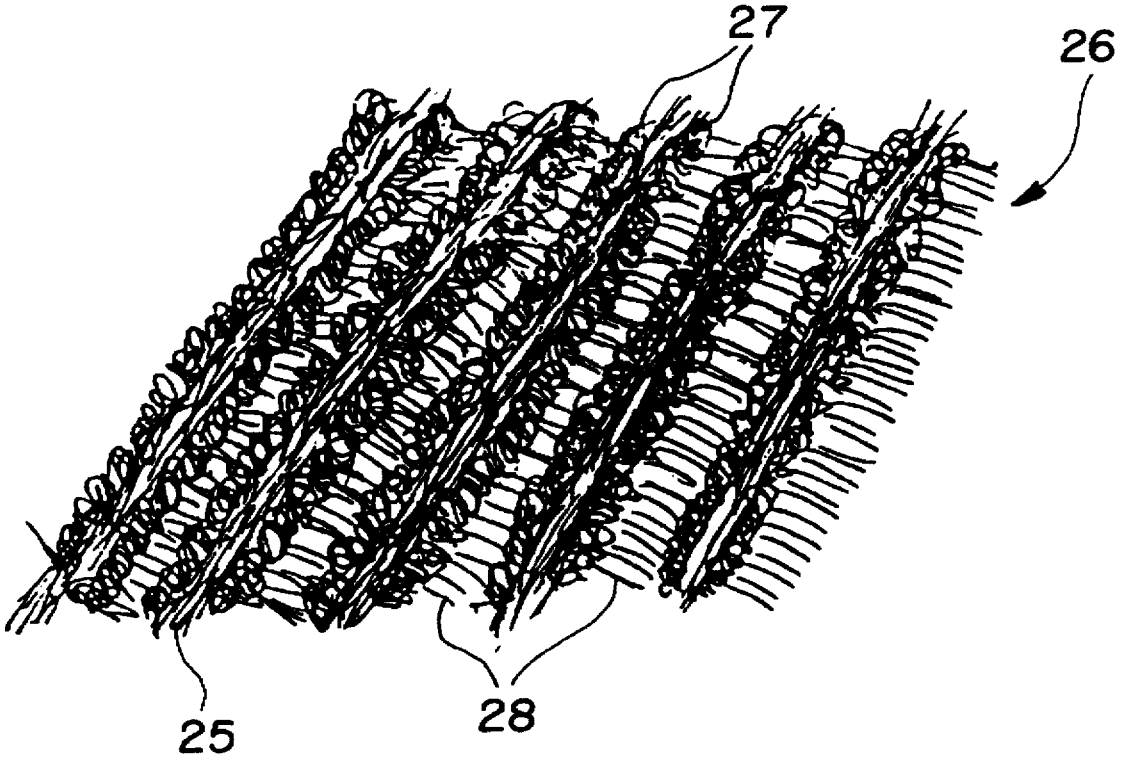
FIG. 2 is a schematic perspective view of the nonwoven fabric photomicrographed in FIG. 1.

In FIG. 2, there is a schematic representation of a non-woven fabric of the present invention. As may be seen, in this embodiment the bands 25 of twisted and turned fiber segments more or less form ribs extending longitudinally of the fabric 26. On each side of these bands and connected to the bands is a plurality of highly entangled fiber segments 27 which extend longitudinally of the fabric. Adjacent the plurality of highly entangled fiber segment areas and connecting the adjacent areas are a plurality of parallel fiber segments 28. These parallel fiber segments are disposed substantially perpendicular to the bands of twisted and turned fiber segments.

Figure 3A:
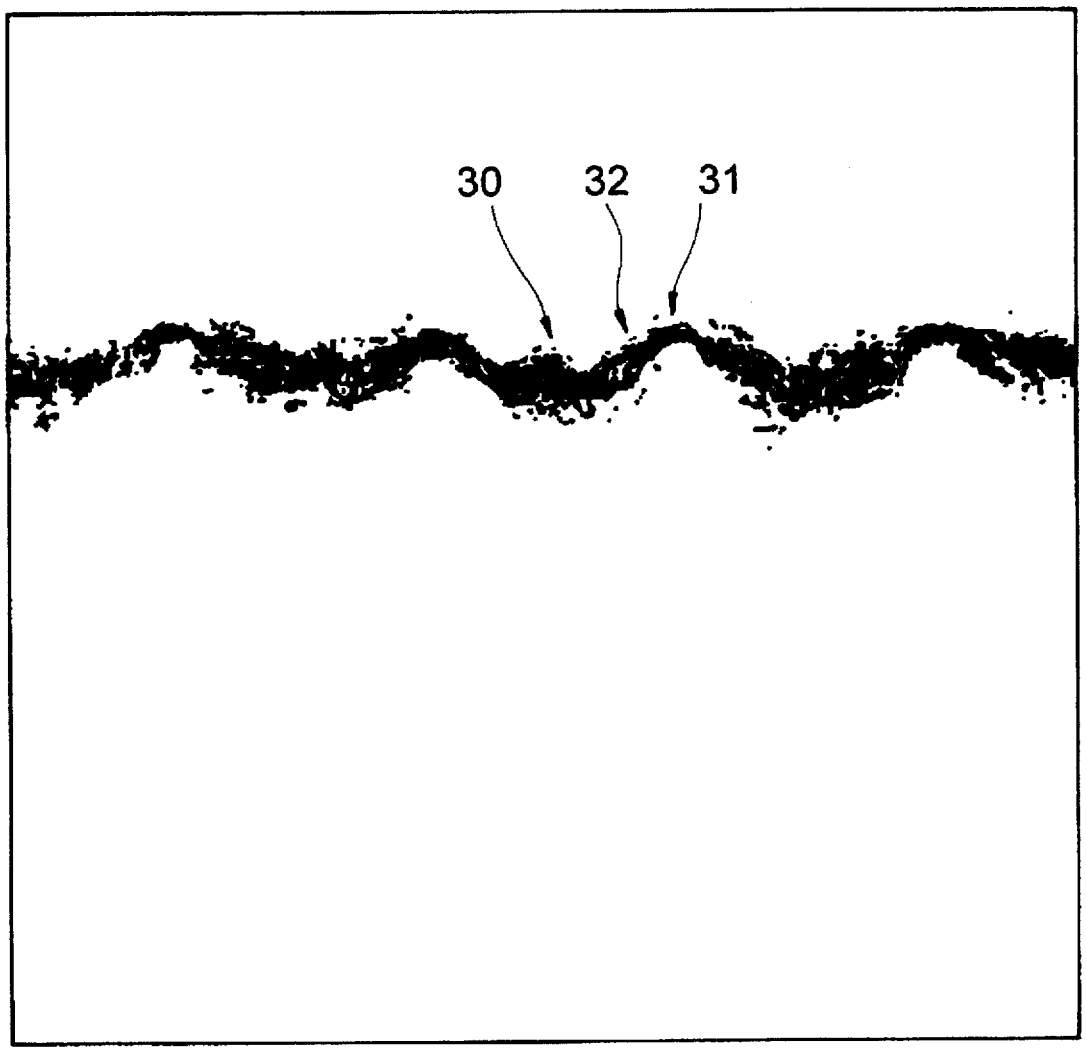
FIG. 3*a* is a computerized image of the fibers of the cross-section of the fabric depicted in FIG. 1 from which a fiber distribution curve is produced.

FIG. 3*a* is a computerized image of is a cross-sectional view of the fabric depicted in FIG. 1. As may be seen in this view, the bands of twisted and turned fiber segments are the thickest areas of the fabric, whereas, the plurality of parallel fiber segments are the thinnest areas of the fabric. These two areas as described above are connected to each other by an area comprising a plurality of highly entangled fiber segments.

The fabrics of the present invention are durable. That is, they have substantial strength even in the absence of binder. Furthermore, the fabrics of the present invention have a unique fiber distribution which provides the fabrics not only with their durability but also with uniform absorbent characteristics.

Figure 4:
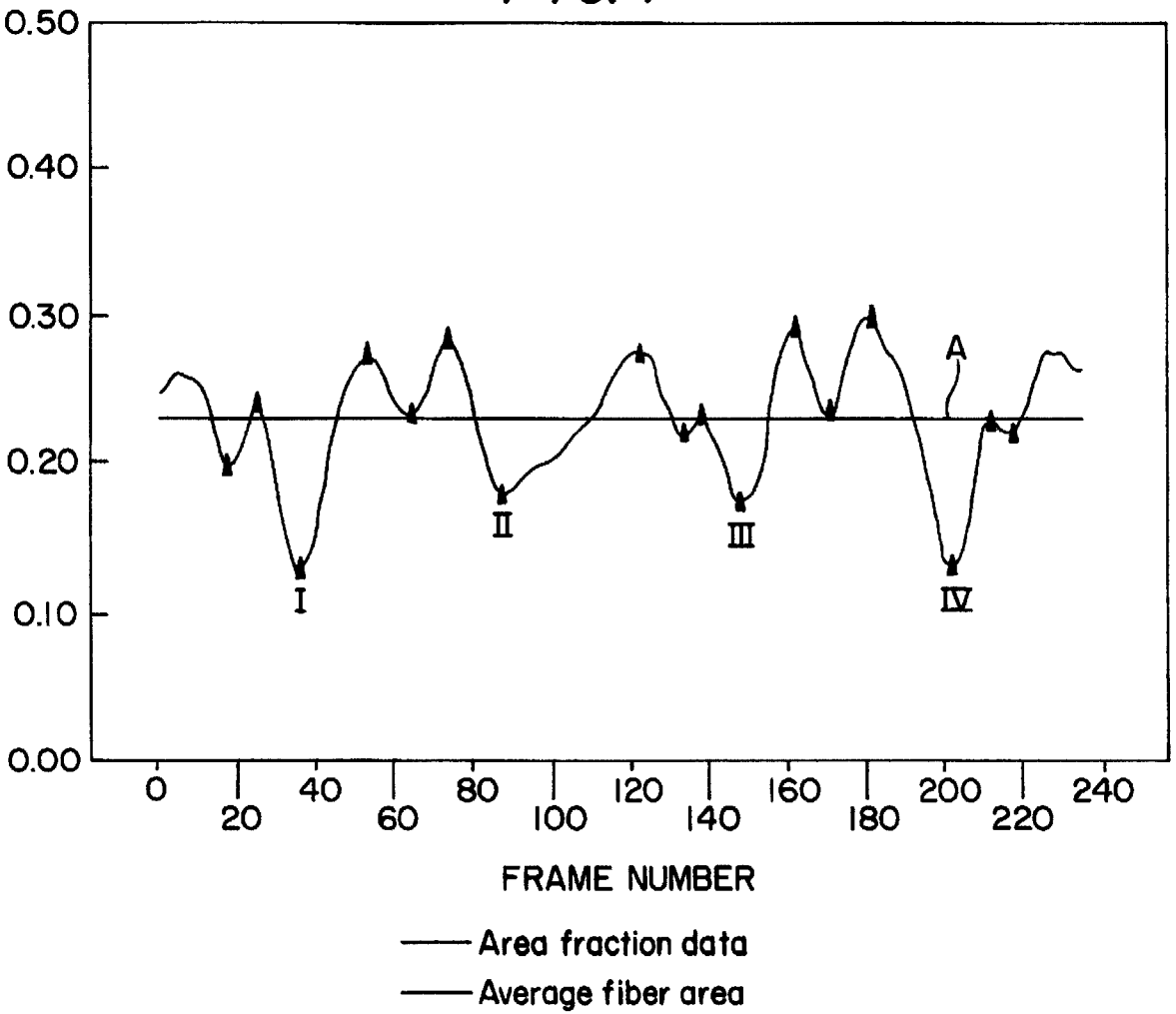
FIG. 4 is a generally sinusoidal fiber distribution developed from the image depicted in FIG. 3*a;*

The fiber distribution of fabrics may be determined by image analysis of the fabric. Imaging analysis using image analyzers such as the Leica Quantimet Q520 have become relatively standard techniques for determining the fiber distribution in fabrics. An image analysis is carried out on a cross-sectional area of the fabric. A piece of fabric is cut to a size of about 1" in the machine direction of the fabric and 3" in the cross-direction of the fabric. The fabric is dried to remove moisture and then embedded in a transparent resin as is well known in the art. In the embedding process, the fabric is maintained in a relatively relaxed state. Once the fabric has been appropriately embedded in a resin, a low speed saw may be used to slice off sections in the cross direction of the fabric. The cut or sliced sections have a thickness of from about 6 to 8 mils. A number of these sections are then analyzed using a Leica Quantimet Q520 image analyzer. A typical image formed by such an image analyzer is shown in FIG. 3*a*. The image analyzer uses a computer to quantify images. The fabric cross section is imaged through a microscope such as an Olympus SZH model equipped with a stabilized transmitter light source. A video camera links the microscope to the image analyzer. This image is transformed to an electronic signal suitable for analysis. The stabilized light source on the microscope is used to produce an image of a suitable visual contrast such that the fiber in the cross section are various shades from gray to black and are readily distinguishable from the pale gray to white resin background as more clearly shown in FIG. 3*a*. This image is divided into sample points or pixels for measurement. The fiber distribution in the cross-section may be characterized by the variation across the section and can be expressed as the area in square millimeters of fibers in a specified rectangular measuring frame. In this instance, the specific measuring frame is 17 pixels wide by 130 pixels high or approximately 95 square millimeters. To determine fiber distribution, the fiber cover or the area of fiber within the measured frame is detected and measured. The measuring frame is then advanced two pixels across the cross-sectional area and the measurement repeated for that adjacent area. This is accomplished anywhere from 200 to 300 times depending on the size of the cross-section. The fiber area in each specific measured area is then plotted on a graph such as that shown in FIG. 4. The amount of fiber coverage is plotted along the ordinate or Y axis and the position of the specific measured area from the starting point is plotted along the abscissa or X axis. As may be seen in FIG. 4, approximately 232 specific sized areas are measured along the cross-section of the fabric. The amount of fiber in each specific measured area is plotted and as may be seen in FIG. 4 varies from about 0.10 or 10% of the measured area being covered by fiber to about 0.30 or 30% of the measured area being covered by fiber. In selecting the size of the measured area, the height of the area should be such that it is greater than any fabric thickness. The width of the area should be selected to give good resolution of fiber areas. Fiber distribution index of the fabric may then be determined from this graph. As seen in FIG. 4, the curve is a generally sinusoidal curve and the fiber distribution index is determined by multiplying the average fiber area covered by the number of clearly identifiable points of minimum fiber coverage over the cross-sectional area and dividing this figure by the average amplitude of the fiber distribution curve.

Referring to FIG. 4, the average fiber area covered is depicted by the dotted line A. In this example, that area of coverage is about 0.23 or 23% of the area of the specific measured area. The cycles or repeats are indicated by the numerals I, II, III, IV. In the repeats I through III, there are a total of 12 maximum and minimum points so there are an average of 4 maximum and minimums in each repeat. On dividing this figure by two, you then have a cycle or a periodicity of two. The average amplitude is determined by measuring the amount of fiber difference between the maximum fiber coverage points and the average fiber coverage and the amount of fiber difference between the minimum fiber coverage points and the average fiber coverage. A maximum fiber coverage point is where the slope of the curve changes from a positive slope to a negative slope. A minimum fiber coverage point is where the slope of the curve changes from a negative slope to a positive slope. The change in slope to be considered a maximum or minimum should occur over at least six measuring frames or a twelve pixel distance. The average amplitude of the curve in FIG. 4 is 0.04. The fiber distribution index of this fabric may then be determined by multiplying the average fiber area coverage of 23% times the cycles or periodicity which is 2, divided by the average amplitude of the curve, which is 0.04, to give a fiber distribution index of 1150. The fiber distribution index of fabrics of the present invention are greater than 600 and preferably are in the range from about 800 to 3300. The fiber distribution index of the fabrics of the prior art are usually considerably lower than 400. In fact, some of the art will have a fiber distribution index of 100 or even lower.

Generally, the fabrics of the present invention will have an average fiber area coverage of from 13% to 24%, a periodicity of from 1.3 to 4, and an average amplitude of from 0.02 to 0.06.

Figure 5:
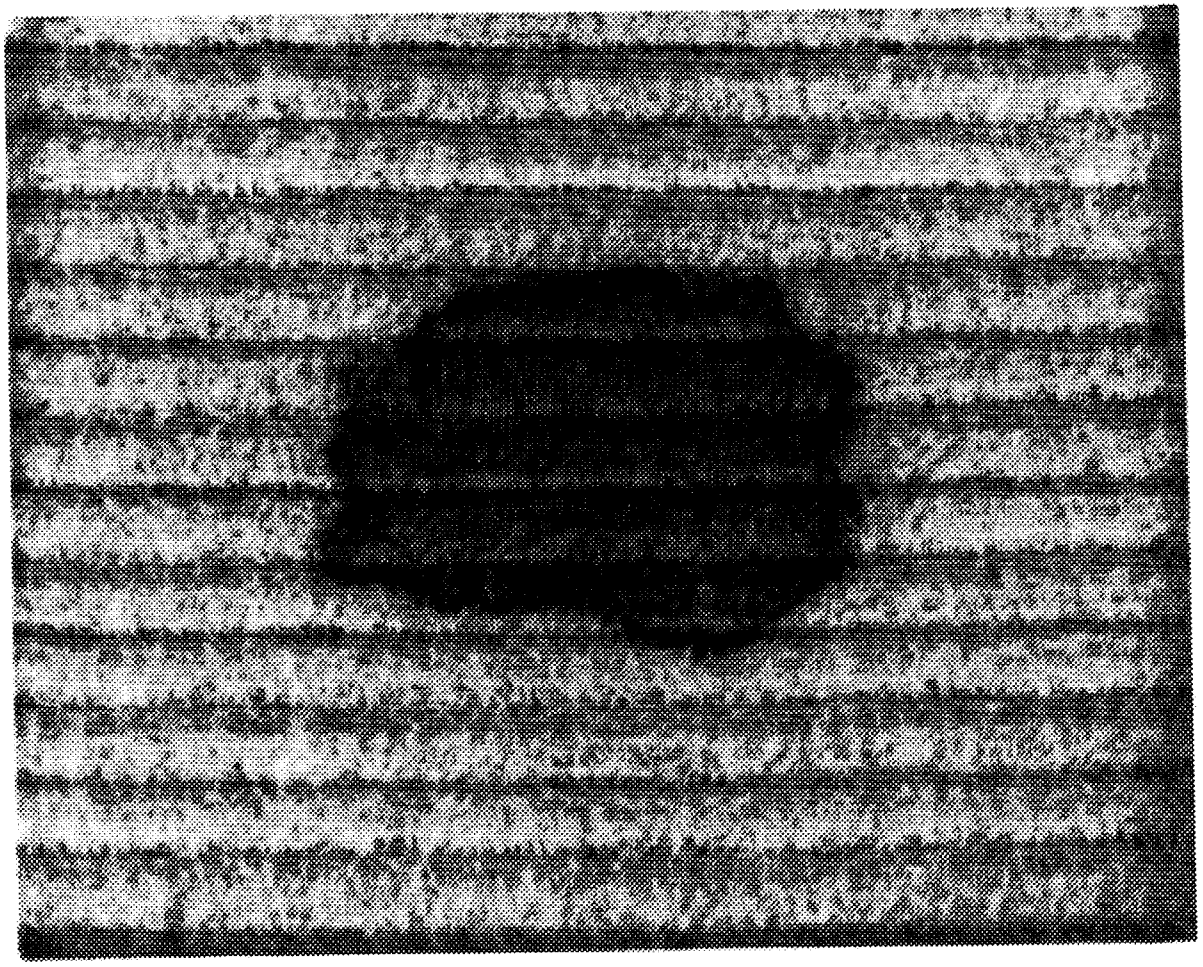
FIG. 5 is a photograph of an absorbency pattern produced by a nonwoven fabric of the present invention.

While the fabrics of the present invention have excellent durability, they also surprisingly and unexpectedly have very desirable absorbent characteristics. Surprisingly, the fabrics of the present invention have relatively uniform absorbent characteristics in that their pattern of absorption has substantially a round shape. Also the perimeter of absorption pattern is relatively smooth. An absorbent pattern of a fabric of the present invention is depicted in FIG. 5.

The absorbent pattern is produced using a test solution of 0.05% Sandolan Rhodamine Red Dye in water. An eye dropper is filled with the test solution. One drop of solution is applied to the fabric being tested. The eye dropper delivers a drop which results in an absorbent pattern of about one inch diameter. The fabric is supported in such a way that there is no contact between fabric and any substrate which could influence the absorbent pattern. A series of drops (at least ten on each side of the fabric) are applied and spaced far enough apart that one drop does not interfere with any adjacent drop. In application, the dropper is positioned approximately one centimeter above the fabric surface and a single drop is expelled from the dropper onto the fabric surface. The supported fabric is allowed to air dry prior to image analysis.

To determine the roundness and the perimeter smoothness of the absorption pattern, the pattern is placed under a microscope and using appropriate computer software is measured for roundness and for form. The roundness is determined by measuring the area of the absorption pattern and also measuring the length that is the longest diameter of the pattern. The roundness factor is determined by multiplying the area of the pattern times 4 and dividing this figure by "pi" times the length of the longest diameter squared. The roundness for a perfect circle is 1. The roundness of the absorption patterns of fabrics of the present invention have a mean roundness factor of at least 0.6 and preferably from about 0.65 to 1.0.

The form factor of the absorbent pattern; that is, the smoothness of the perimeter, is determined by measuring the area of the absorption pattern and the perimeter of the absorption pattern. The form factor is equal to 4 times "pi" times the area of the absorption pattern divided by the perimeter squared of the absorption pattern. For a perfectly smooth circle, the form factor is 1. The absorption pattern of the fabrics of the present invention have a mean form factor of at least 0.7 and preferably from about 0.75 to 1.0.

By "mean" roundness factor and "mean" form factor it is meant the arithmetical average of at least 15 measurements.

Figure 6:
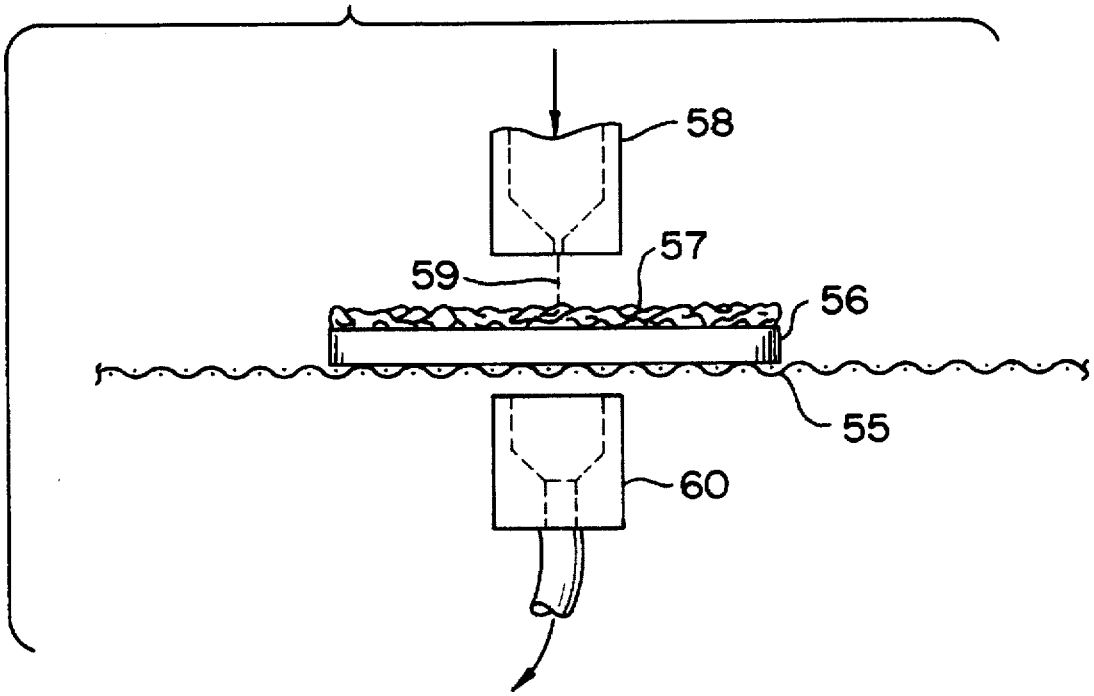
FIG. 6 is a schematic sectional view of one type of apparatus for producing nonwoven fabrics of the preset invention.

FIG. 6 is a schematic cross-sectional view of apparatus which may be used to produce fabrics of the present invention. The apparatus includes a movable conveyer belt 55. Placed on top of this belt to move with the belt is a topographically novel configured support member 56. The support member has a plurality of longitudinally extending raised triangular areas. Holes, or openings extending through the support member, are disposed between triangular areas as will be more fully discussed in conjunction with FIG. 8. The fiber web 57 to be treated is disposed or supported by the apex of these triangular areas. Openings in the support member are disposed between the triangular areas. Specific forming members will be more fully described hereinafter. As previously mentioned, placed on top of this support member is a web of fibers. The web may be a nonwoven web of carded fibers, air-laid fibers, melt blown fibers, or the like. Above the fiber web is a manifold 58 for applying fluid 59, preferably water, through the fibrous web as the fibrous web is supported on the support member and moved on the conveyer belt beneath the manifold. The water may be applied at varying pressures. Disposed beneath the conveyer belt is a vacuum manifold 60 for removing water from the area as the web and support member are passed under the fluid manifold. In operation, the fiber web is placed on the support member and the fiber web and support member passed under the fluid manifold. Water is applied to the fibers to wet out the fiber web to be certain the web is not removed or disrupted from its position on the support member on further treatment. Thereafter, the support member and web are passed beneath the manifold a series of times. During these passes, the pressure of the water of the manifold is increased from a starting pressure of about 100 PSI to pressures of 1000 PSI or more. The manifold consists of a plurality of orifices of from about 4 to 100 or more holes per inch. Preferably, the number of holes in the manifold is from 13 to 70 per inch.

In this embodiment, there are about 12 longitudinal ribs per inch of web. These triangular longitudinal ribs have a height of about 0.085 inches. The width at the base of the triangular areas is about 0.030 inches. The distance between triangular areas is approximately 0.053 inches. The holes in the support member have a diameter of about 0.044 inches and are spaced on 0.0762 inch centers. After the web and support member are passed under the manifold a series of times, the water is stopped and the vacuum continued to assist in dewatering the web. The web is then removed from the support member and dried to produce a fabric as described in conjunction with FIGS. 1 through 3.

Figure 7:
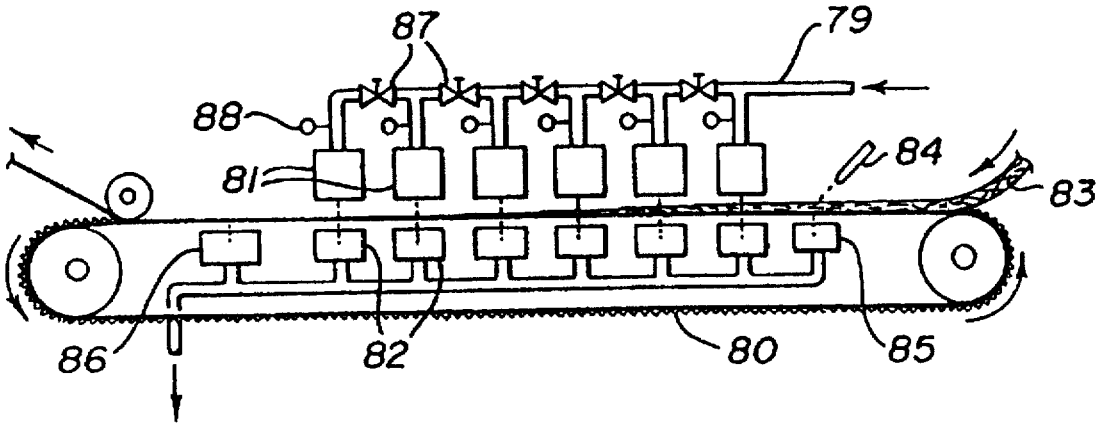
FIG. 7 is a diagrammatic view of another type of apparatus for producing the nonwoven fabrics of the present invention.

In FIG. 7, there is depicted an apparatus for continuously producing fabrics in accordance with the present invention. The schematic representation includes a conveyer belt 80 which serves as the support member in accordance with the present invention. The belt is continuously moved in a counterclockwise direction about spaced apart members as is well known in the art. Disposed above this belt is a fluid feeding manifold connecting a plurality of lines or groups 81 of orifices. Each group has one or more rows of fine diameter holes with 30 or more holes per inch. The manifold is equipped with pressure gauges 87 and control valves 88 for regulating fluid pressure in each line or group of orifices. Disposed beneath each orifice line or group is a suction member 82 for removing excess water and to keep the water from causing undue flooding. The fiber web 83 to be treated and formed into a fabric of the present invention is fed to the support member conveyer belt. Water is sprayed through an appropriate nozzle 84 onto the fibrous web to pre-soak or pre-water the web and aid in controlling the fibers as they pass under the pressure manifolds. A suction box 85 is placed beneath the water nozzle to remove excess water. The fibrous web passes under the fluid feeding manifold with the manifold preferably having progressively increased pressures. For example, the first line of holes or orifices may supply fluid forces at 100 PSI while the next line of orifices may supply fluid forces at a pressure of 300 PSI and the last line of orifices may supply fluid forces at a pressure of 700 PSI. Though six lines of orifices are shown, the number of lines or rows of orifices is not critical but will depend on the width of the web, the speed, the pressures used, the number of rows of holes in each line, etc. After passing between the fluid feeding and suction manifolds, the formed fabric is passed over an additional suction box 86 to remove excess water from the web. The support member may be made from relatively rigid material and may comprise a plurality of slats. Each slat extends across the width of the conveyer and has a lip on one side and a shoulder on the opposite side so that the shoulder of one slot engages with the lip of an adjacent slot to allow for movement between adjacent slots and allow for these relatively rigid members to be used in the conveyer configuration shown in FIG. 7. Each orifice strip comprises one or more rows of very fine diameter holes of approximately 1/5000 of an inch to 10/1000 of an inch in diameter. There are approximately 50 holes per inch across the orifice.

Figure 8:
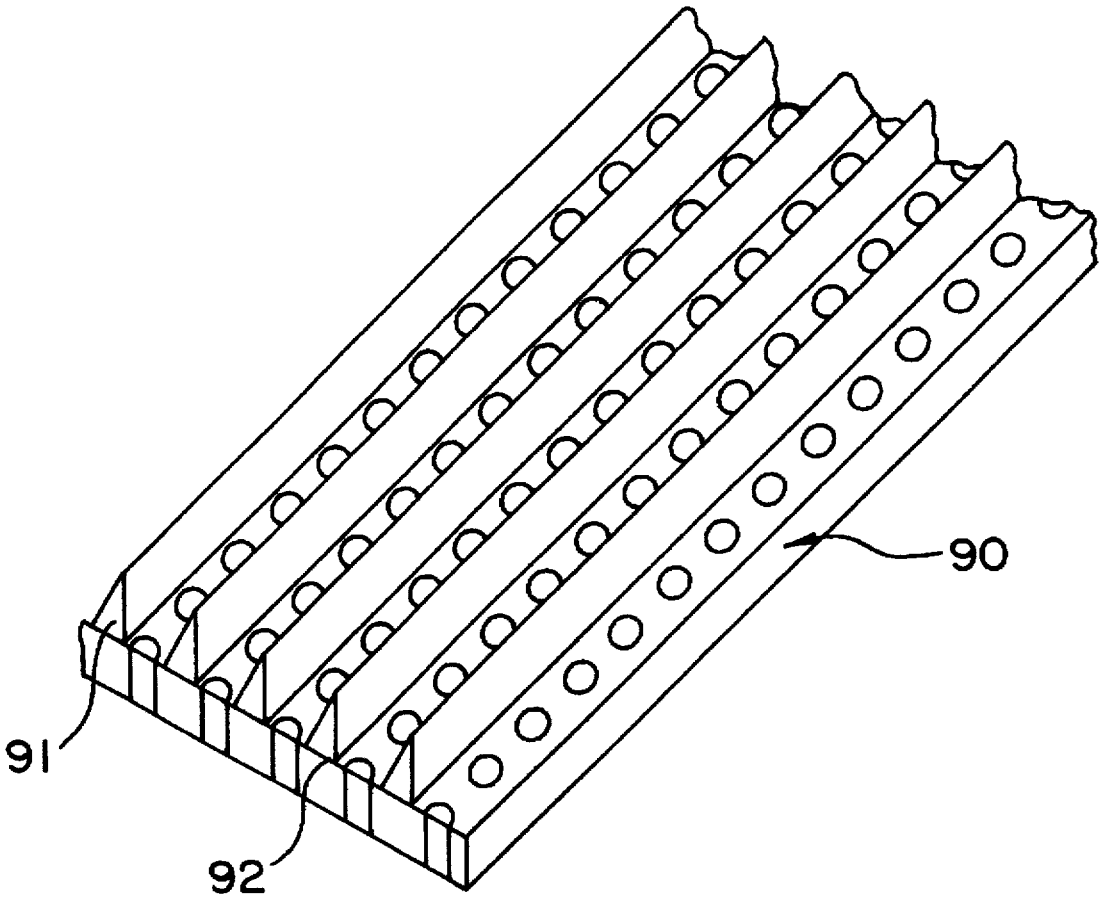
FIG. 8 is an enlarged perspective view of one type of topographic support member that may be used in the apparatus depicted in FIG. 7.

FIG. 8 is a perspective view of one type of support member that may be used to produce the fabrics of the present invention. The member comprises a plate 90 having longitudinally spaced apart raised rib areas 91. The plate has 12 of these raised rib areas per inch of width. The raised areas have a triangular cross-sectional shape with the width at the bottom of the triangular being approximately 0.03 inches. These ribs are 0.085 inches in height and come to a point having an occluded angle of about 20 degrees. The base of the rib is spaced from the base of the adjacent rib about 0.053 inches. In this area between ribs there are openings 92 or holes in the plate. These openings also extend the length or longitudinally of the plate between each adjacent ribs. The openings have a diameter of about 0.044 inches and are spaced on 0.0762 inch centers. The raised areas of the support members used to produce the fabrics of the present invention should have a height of at least 0.02 inches. Their bottom width should be from about 0.04 inches to 0.08 inches and their top width must be less than or equal to the bottom width. In the preferred embodiments of the support members used in the present invention, the cross sectional area is triangular so that the top width is in fact 0. The spacing between adjacent raised areas should be at least 0.04 inches. The openings in the spacing between adjacent areas should be from about 0.01 in. to 0.045 in. in diameter, with the distance between openings being from about 0.03 to 0.1 in.

Following is a specific example of a method for producing fabrics of the present invention.

EXAMPLE 1

Apparatus as depicted and described in regard to FIG. 2 is used to produce the fabric. A 2½ oz/per square yard fiber web of 100% cotton is prepared by taking a 1½ ounce per square yard random web and laminating it on top of a one ounce per square yard carded web. This laminated web is placed on a support member as described in conjunction with FIG. 8. The support member and web are passed, at a speed of 92 feet per minute, under columnar jet streams produced from the orifices as depicted in FIG. 8. Three passes are made at a pressure of 100 PSI and 9 passes are made at pressure of 800 PSI. The orifices have a 0.007 inch diameter and there are approximately 30 orifices per inch so that the energy applied is approximately 0.8 horse power hours per pound. The web is spaced from the orifices approximately 0.75 inches. After accomplishing this first processing, the web is removed from the support member and turned over so that the opposite side of the web now faces the orifice jets. The support member with the reversed web is placed under the water jets at a speed of 4 yards per minute. The web and support member are passed once at 600 PSI and two additional passes at 1500 PSI. The web is dried and the fiber distribution of the web determined. The fiber distribution index of this web is approximately 820. Samples of the web are tested for absorbent characteristics utilizing the absorbency test previously described. The mean roundness factor of the absorbent pattern of this sample is approximately 0.6 and the mean form factor of the absorbent pattern of this sample is approximately 0.72.

While the support members used to produce the fabrics described previously all have had longitudinally extending ribs it is not necessary that the ribs be longitudinally extended. Support members having horizontal ribs or diagonal ribs or combinations of diagonal, horizontal, and/or longitudinal ribs may be used to produce fabrics in accordance with the present invention.

Figure 9:
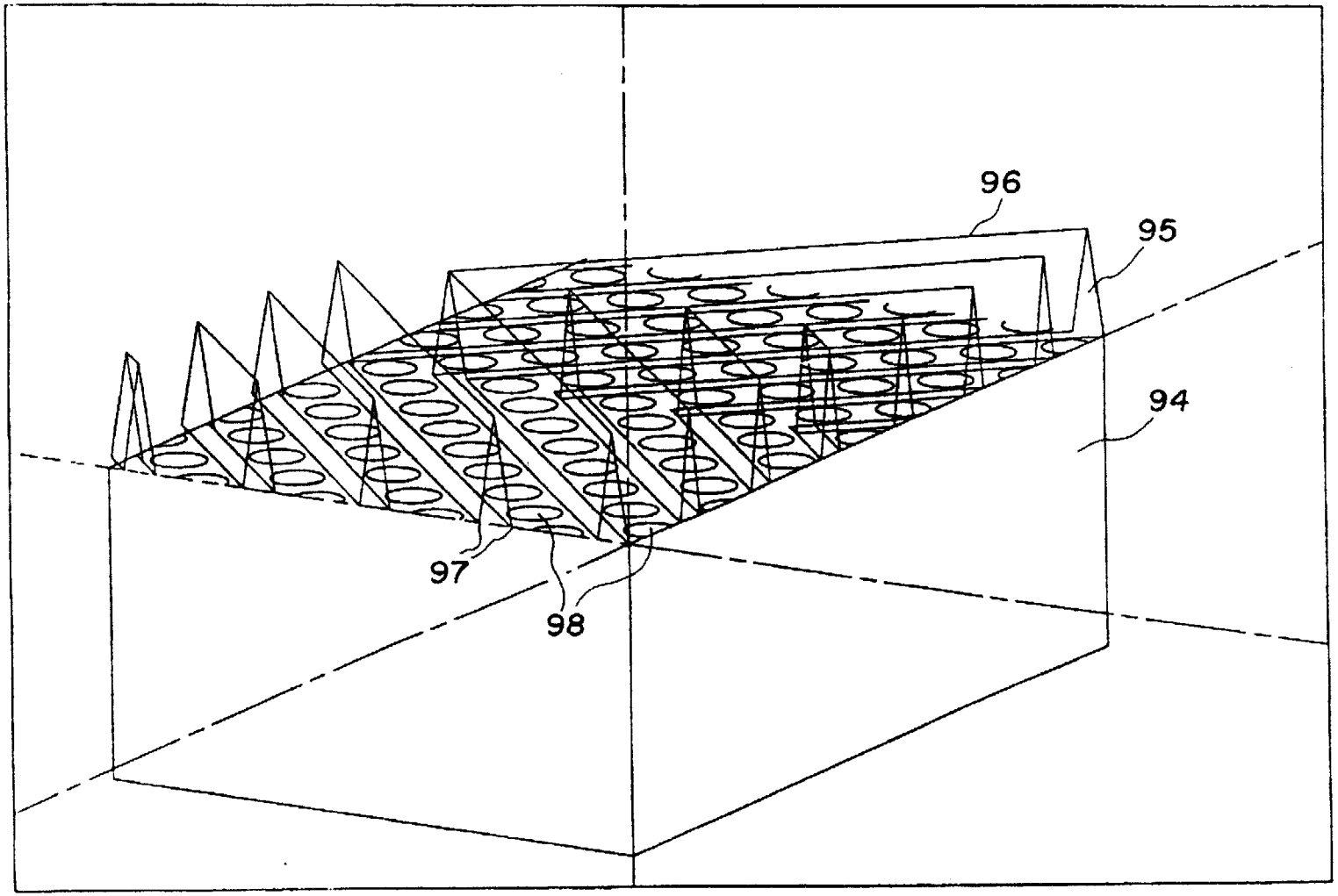
FIG. 9 is an enlarged perspective view of yet another type of topographical support member that may be used to produce the fabrics of the present invention.

In FIG. 9 there is shown another type of forming plate that may be used to produce fabrics of the present invention. The member comprises a plate 94 having diagonally disposed raised rib areas 95. The rib areas are disposed in a herring-bone pattern. The pattern is made of slanting parallel lines in rows with adjacent rows forming a V or inverted V. Each rib has a triangular shape cross-section with the apex 96 of the triangle forming the upper surface of the member. Between parallel rows of its areas at the base 97 of the triangle is a plurality of openings 98 or holes extending through the thickness of the plate.

Figure 10:
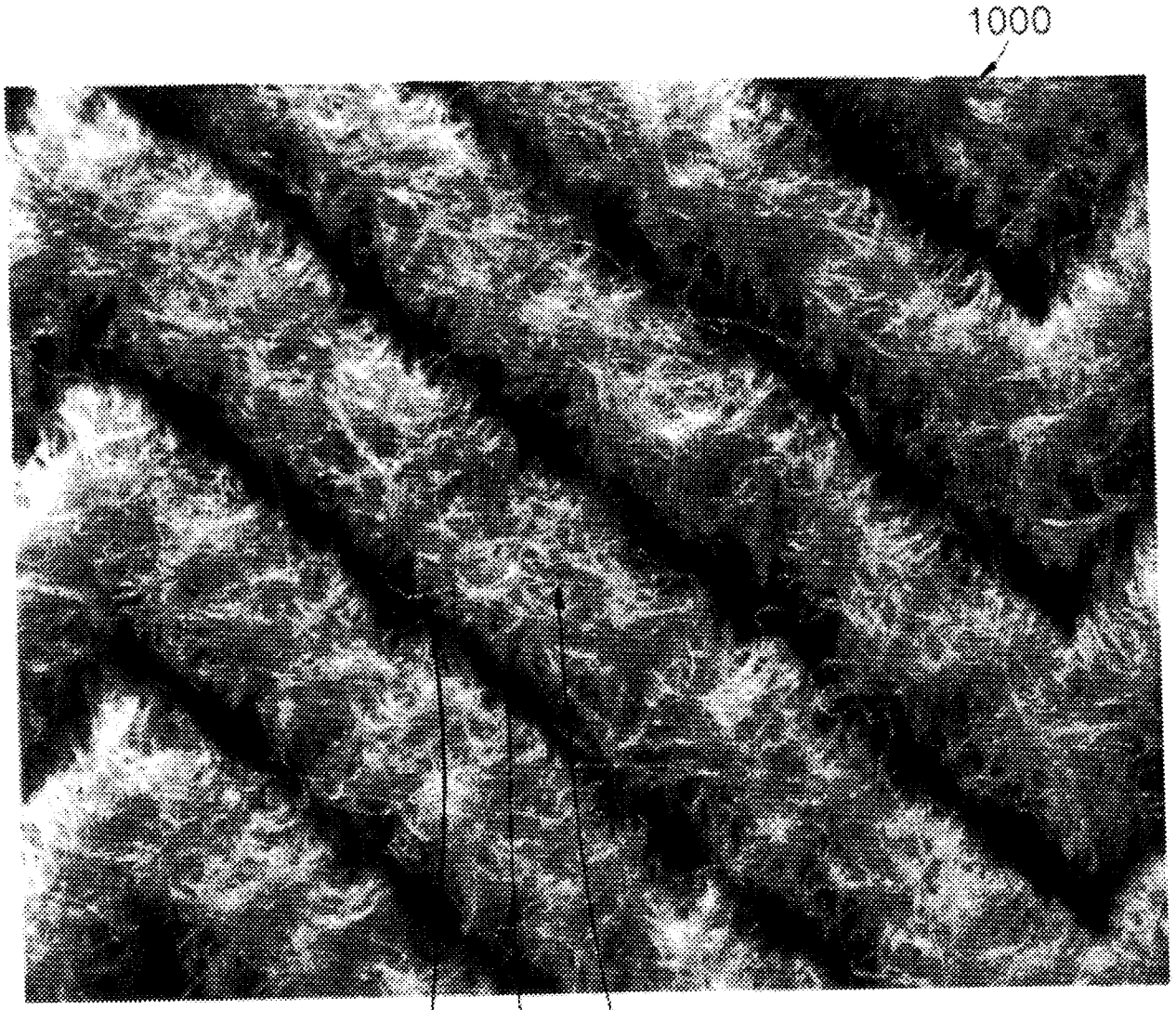
FIG. 10 is a photo micrograph of another nonwoven fabric in accordance with the present invention enlarged about 20 times.

Referring to FIG. 10 there is shown a photomicrograph of a fabric according to the present invention which was produced utilizing the support member depicted in FIG. 9.

EXAMPLE 2

The fabric depicted in FIG. 10 is prepared from a 2⅓ oz. per sq. yd. fiber web of 100% cotton. The web is pretreated by placing it on a 100×92 mesh bronze belt and passing the web under columnar water jet streams at 92 feet/min. Three passes under the streams at 100 psig are made followed by 9 passes at 800 psig. The jet streams are produced from 0.007 in diameter orifices arranged in a line with 30 orifices per inch. The web to orifice spacing is 0.75 inch. The pretreated web is taken from the bronze belt and turned over and the surface of the pretreated web exposed to the water jet streams placed on a forming plate as depicted in FIG. 9. The web and forming plate are passed under the columnar jet streams as described above at a speed of 90 ft/minute. One pass is made at 600 psig and 7 passes at 1400 psig. The treated web is removed from the forming plate and directed to produce the fabric shown in FIG. 10.

As seen in the photomicrograph the fabric 1000 has a herring-bone pattern of three interconnected fiber arrays. The first fiber array 101 comprises a plurality of fiber segments. The second fiber array 102 is a band of twisted and turned fiber segments with the band disposed substantially perpendicular to the parallel fiber segments. The third fiber array 103 in interconnects the first and second fiber arrays and comprises a plurality of highly entangled fiber segments.

Having now described the invention in specific detail, and an exemplified manner in which it may be carried into practice, it will be readily apparent to those skilled in the art that many variations, applications, modifications, and extensions of the basic principals involved may be made without departing from its spirit or scope.

What is claimed is:

1. A nonwoven fabric having a repeating pattern of three interconnected fiber arrays;

a first fiber array comprising a plurality of parallel fiber segments;

a second fiber array adjacent to said first fiber array, said second fiber array comprising a plurality of twisted and turned fiber segments that form a band disposed substantially perpendicular to said parallel fiber segments; and a third fiber array interconnecting said first and second fiber arrays, said third fiber array comprising a plurality of highly entangled fiber segments;

said fabric having substantially uniform absorbent characteristics in all directions within the plane of the fabric.

2. A nonwoven fabric according to claim 1 wherein the bands are continuous and extend the length of the fabric.

3. A nonwoven fabric according to claim 1 wherein the bands are uniformly spaced from adjacent bands.

4. A nonwoven fabric having substantially uniform absorbent characteristics and a generally sinusoidal fiber distribution curve over its cross-sectional area which said cross-sectional area is taken over a repeating pattern three interconnected fiber arrays of said fabric, said fiber distribution curve being defined by a percentage of area covered by fibers, said curve resulting from a plurality of fiber coverage points indicative of the amount of fiber coverage at equally spaced locations across the cross-sectional area of the fabric, said fabric having a repeating pattern of three interconnected fiber arrays, the first fiber array including a plurality of parallel fiber segments, the second fiber array including a plurality of twisted and turned fiber segments which form a band that is disposed substantially perpendicular to the parallel fiber segments of the first fiber array, the third fiber array interconnecting the first and second fiber arrays and comprising a plurality of highly entangled fiber segments, said fiber arrays being constructed and arranged such that an average percentage of area of fiber coverage in a cross-section of the fabric times ½ an average number of maximum and minimum fiber coverage points in a cycle of said generally sinusoidal fiber distribution curve divided by an average amplitude of the generally sinusoidal fiber distribution curve is at least 600, wherein the average number of maximum coverage and minimum coverage points in a cycle is 4 or more to provide a periodicity of at least 2.

5. A nonwoven fabric according to claim 4 wherein the average percentage of area of fiber coverage is from 800 to 3300.

6. A nonwoven fabric according to claim 4 wherein the average amplitude of the fiber distribution curve is from 0.02 to 0.06.

7. A nonwoven fabric according to claim 4 having an average percentage of area of fiber coverage of at least 13%, the average number of minimum and maximum fiber coverage points in a cycle is 4 or more and the average amplitude of said fiber distribution curve is from 0.02 to 0.06.

* * * * *